United States Patent [19]

Laskaris

[11] Patent Number: 4,522,034

[45] Date of Patent: Jun. 11, 1985

[54] HORIZONTAL CRYOSTAT PENETRATION INSERT AND ASSEMBLY

[75] Inventor: Evangelos T. Laskaris, Schenectady, N.Y.

[73] Assignee: General Electric Company, Schenectady, N.Y.

[21] Appl. No.: 595,199

[22] Filed: Mar. 30, 1984

[51] Int. Cl.[3] ..... F17C 1/00

[52] U.S. Cl. ..... 62/45; 62/55; 62/514 R

[58] Field of Search ..... 62/45, 55, 514 R

[56] References Cited

U.S. PATENT DOCUMENTS

| | | | |
|---|---|---|---|
| 3,066,222 | 11/1962 | Poorman et al. | 62/514 R |
| 3,309,884 | 3/1967 | Pauliukonis | 62/45 |
| 3,377,813 | 4/1968 | Mordhorst | 62/45 |
| 3,399,691 | 9/1968 | Schoch et al. | 62/55 |
| 3,483,709 | 12/1969 | Biacher et al. | 62/514 R |
| 3,714,942 | 2/1973 | Fischel et al. | 62/45 |
| 4,223,540 | 9/1980 | Longsworth | 62/514 R |

*Primary Examiner*—Ronald C. Capossela
*Attorney, Agent, or Firm*—Lawrence D. Cutter; James C. Davis, Jr.; Marvin Snyder

[57] ABSTRACT

An insert for a horizontal cryostat penetration comprises a plurality of foam plugs between which are disposed patches of copper or aluminum foil. The plugs and foil are disposed in a tubular conduit comprising thin wall, low thermal conductivity material. This plug provides thermal insulation and significantly reduces the formation of convection currents in the penetration which would otherwise significantly increase the rate of coolant evaporation. The insert assembly described is designed to be ejected from the penetration upon the build up of excessive internal pressure. The insert is also preferably disposed within another tubular conduit around the exterior of which there is disposed one or more string-shaped helically disposed lengths of sealing material. Accordingly, when this assembly is inserted within a third conduit, a helical coolant vapor path is formed for exterior venting.

27 Claims, 3 Drawing Figures

HORIZONTAL CRYOSTAT PENETRATION INSERT AND ASSEMBLY

BACKGROUND OF THE INVENTION

The present invention is generally directed to horizontal penetrations extending between the inner and outer walls of a cryostat, particularly one employing liquid helium as a coolant material. More particularly, the present invention is directed to an insert for this penetration and a horizontal penetration assembly employing such an insert.

In the generation of medical diagnostic images in nuclear magnetic resonance imaging, it is necessary to provide a temporally stable and spatially homogeneous magnetic field. The use of superconductive electrical materials maintained at a temperature below their critical transition temperatures provides an advantageous means to produce such a field. Accordingly, for such NMR imaging devices, a cryostat is employed. The cryostat contains an innermost chamber in which liquid helium, for example, is employed to cool the superconductive materials. The cryostat itself typically comprises a toroidal structure with other nested toroidal structures inside the exterior vessel to provide vacuum conditions and thermal shielding.

Since it is necessary to provide electrical energy to the main coil magnet, to various correction coils and to various gradient coils employed in NMR imaging, it is necessary that there be at least one penetration through the vessel walls. Typical prior art penetrations have been vertical. However, from a manufacturing viewpoint, the construction of vertical penetrations has produced undesirable, problems of alignment and assembly. However, horizontal cryostat penetrations have not been employed for reasons of thermal efficiency. In particular, it is seen that for a coolant such as liquid helium, that there is a large dependency of vapor density upon temperature. Accordingly, helium vapor found within a vertical penetration is naturally disposed in a layered configuration as a result of the density variation from the bottom to the top of the penetration. This layering provides a natural form of thermal insulation along the length of a vertical penetration. In particular, at any position along the axis of such penetration the temperature profile is substantially constant. However, this would not be the case for a horizontal cryostat penetration since any layering that would result would not be in the direction of the long axis of the cryostat penetration. Accordingly, the temperature gradient along the penetration would tend to set up convection currents in the vapor within the penetration. This would result in a much more rapid loss of coolant than is desired. Since the cost of helium is relatively high, it is seen that this loss of coolant is particularly undesirable.

Moreover, as a result of an as yet not fully understood phenomena, it is possible for superconductive windings within the cryostat to undergo a sudden transition from the superconducting state to the normal resistive state. In this circumstance, the electrical energy contained within the coil is rapidly dissipated as resistive ($I_2R$) heating of the windings. This can result in a rapid increase in internal helium vapor pressure and accordingly, any cryostat penetration must be provided with pressure relief means.

Furthermore, vacuum conditions are maintained between the innermost and outermost cryostat vessels. If for some reason, a loss of vacuum occurs in this volume, it is also possible to develop a rapid increase in the coolant vapor pressure. For this reason also, pressure relief means are desirable for cryostat penetrations.

Accordingly, it is seen that because of the large density changes between cold and warm helium, free convection secondary flows are easily set up in horizontal cryostat penetrations. These flows considerably degrade the thermal efficiency of horizontal penetration. If the penetration is densely packed with foam or equipped with a vapor cooled, thermally efficient blowout plug, pressure relief of the vessel could be obstructed by frost buildup in the vapor cooled channel. It is therefore seen that horizontal cryostat penetrations for NMR magnet cryostats require thermally efficient inserts that supress free convection flow. These inserts must also provide sufficient exhaust area to relieve internal vessel pressure in case of magnet quench or vacuum loss.

SUMMARY OF THE INVENTION

In accordance with a preferred embodiment of the present invention an insert for a horizontal cryostat penetration comprises a thin wall tube, a plurality of foam plugs disposed within and substantially filling the tube and a plurality of thermally conductive foil patches disposed between the foam plugs. The conductive foil patches promote a substantially constant temperature across any cross section which substantially lies at a right angle with respect to the axis of the penetration plug. In accordance with another preferred embodiment of the present invention, a horizontal penetration assembly for a cryostat having an inner vessel wall and an outermost vessel wall comprises an outer tubular conduit passing at least partially through an aperture in the inner vessel wall and an aperture in the outer vessel wall wherein the conduit is sealably joined to the respective vessel walls. This embodiment also comprises an inner tubular conduit disposed substantially coaxially with said outer conduit and at least one string-shaped length of sealing material disposed in a helical pattern between the inner and outer tubular conduits so as to define a helical path between these conduits so that the path is in flow communication with the interior volume of the cryostat. The inner tubular conduit preferably includes the above described insert. This insert is disposed directly within the tubular conduit and is preferably positioned with respect to a rupture disk so as to permit its ejection from the penetration when the rupture disk bursts. This horizontal penetration assembly may also be combined with an exterior flange so as to form a single removable unit. The cryostat penetration of the present invention is particularly useful in systems employing retractable electrical leads or leads having contact surfaces within the innermost cryostat vessel.

Accordingly, it is an object of the present invention to provide a thermally efficient cryostat penetration insert and assembly that can reliably relieve the pressure of the vessel.

It is also an object of the present invention to provide a cryostat penetration in which free convection secondary flows are not established.

It is a still further object of the present invention to provide a cryostat penetration insert that is not obstructed by frost buildup in the channel in which it is disposed.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
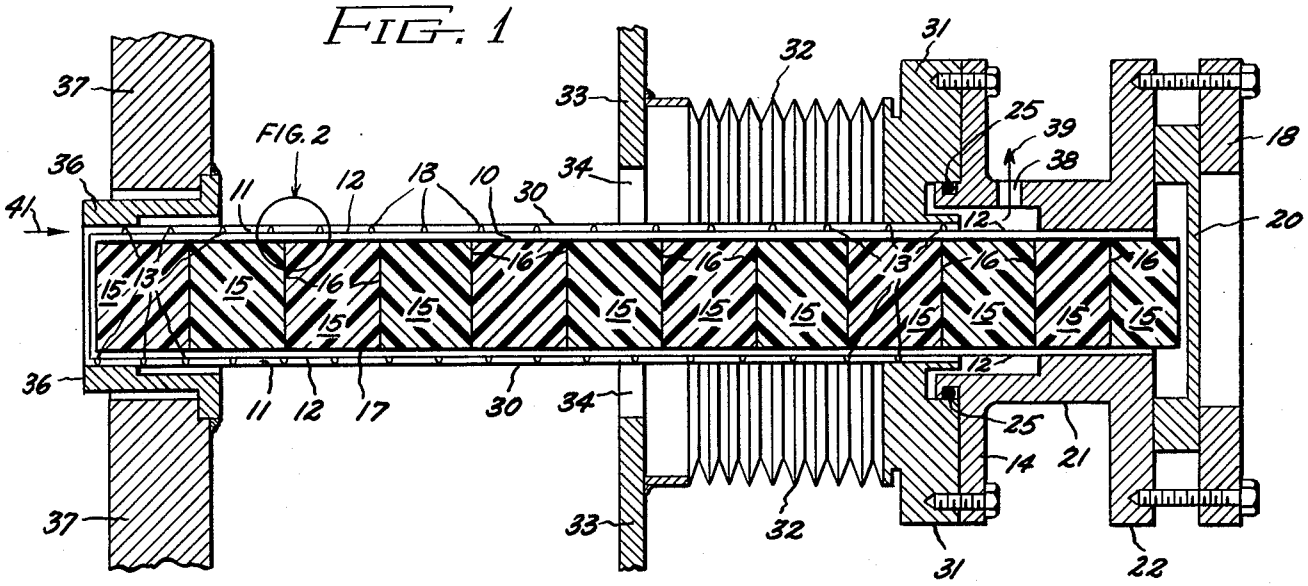
FIG. 1 is a cross-sectional side elevation view illustrating the insert and penetration assembly of the present invention.

A preferred embodiment of the present invention is illustrated in FIG. 1. In particular, FIG. 1 illustrates a horizontal cryostat penetration in which there are shown two distinct and separable assemblies. The particular elements which comprise these two assemblies are described in detail below. Suffice it to say for now that the two assemblies essentially comprise the stationary parts of the cryostat itself and the removable insert assembly of the present invention.

The elements comprising the stationary cryostat itself are considered first. In particular, the cryostat includes inner vessel wall 37 and outermost vessel wall 33 with flange 31. In operation, vacuum conditions are maintained between these walls. FIG. 1 also indicates aperture 34 in wall 33 through which the penetration assembly of the present invention is disposed. Furthermore, which FIG. 1 illustrates a limited number of vessel walls, it should be understood that other nested, intermediate vessel walls may be provided as circumstances dictate in various cryostat designs. To accommodate thermal expansion and contraction effects, bellows assembly 32 is typically disposed between outermost vessel wall 33 and flange 31. Walls 31 and 37 are both provided with aligned apertures for accommodation of the horizontal penetration. More particularly, collar 36 is typically disposed in an aperture in wall 37 and is sealed to wall 37, for example, by welding. Inner vessel wall 37 and collar 36 typically comprise material such as aluminum. Outermost vessel wall 33 with flange 31 typically comprises a low thermal conductivity material such as stainless steel. Lastly, as shown in FIG. 1, the stationary cryostat structure includes outer tubular conduit 30 which passes at least partially through apertures in walls 37 and 31. Additionally, outer conduit 30 is sealably joined to walls 37 and 31. In particular, in the case of wall 37, tubular conduit 30 is adjoined thereto by means of collar 36. Outer tubular conduit 30 typically comprises a low thermal conductivity material such as stainless steel. Accordingly, it is seen that walls 31 and 37, collar 36 and conduit 30 comprise a stationary structure in which the insert and penetration insert assembly of the present invention may be disposed.

The remaining structures of FIG. 1 comprise the insert and penetration assembly of the present invention. The insert plug itself comprises foam plugs 15, thermally conductive patches 16 and thin wall tube 17, all of which are considered in detail below. However, the present invention also includes exterior collar 21 with flanges 14 and 22. In particular, flange 14 abuts exterior vessel flange 31. Flange 14 is sealably held against wall 31, for example, by means of bolts as shown. However, any other convenient fastening means may be provided. A sealant function is also provided by O-ring 25 disposed within an annular groove in flange 14, as shown. Collar 21 is also preferably provided with flange 22 against which rupture disk 20 is held by means of annular washer 18 which is in turn fastened to flange 22, for example, by bolts as shown. Again, any other convenient fastening means may be employed.

It is also important to note that inner tubular conduit 12 is sealably disposed in an aperture in collar 21. This conduit extends so as to be substantially coaxial with outer tubular conduit 30. Conduit 12 preferably comprises a low thermal conductivity material such as stainless steel. However, thin walled glass fiber material may also be employed.

Another important feature of the present invention that is illustrated in FIG. 1 is that there is disposed about the exterior of conduit 12 a string-shaped length of sealing material 13 arranged in a substantially helical pattern between inner tubular conduit 12 and outer tubular conduit 30. Sealing material 13 may comprise gasket material or may simply comprise a length of twine. It is additionally noted that while FIG. 1 depicts sealing material 13 as being disposed in a substantially uniform manner about conduit 12, it is also desirable to dispose sealing material 13 in a helical pattern having a variable pitch. In particular, it is possible to dispose sealing material 13 so that the pitch of the helical pattern increases in a direction extending from inner vessel wall 37 to outermost vessel flange 31. It is also noted that while it is possible to dispose sealing material 13 in a single helical pattern, it is also possible to employ one or more lengths of sealing material disposed in a double or triple helical pattern. In either case, it is seen that sealing material 13 provides a helical flow path for coolant vapor from the interior of the cryostat to its exterior. In particular, FIG. 1 illustrates coolant flow arrow 41 directed to the start of the helical path which extends around and along gap 11 between conduits 30 and 12. By providing a flow path of this configuration, several advantages are achieved. In particular, the temperature throughout any cross section along the axial length of the penetration is substantially constant. This temperature distribution is useful in the prevention of the establishment of convection current flowpaths for the coolant vapor in the penetration. It is further seen that the coolant vapor exists the exterior end of gap 11 and is ultimately exhausted to the exterior ambient environment through aperture 38 in collar 21, as indicated by flow arrow 39. It is in particular to be noted that this flow path is not in fluid communication with the interior region of conduit 12 (except at the cold, interior end of the penetration). Accordingly, the axial and circumferential flow occurring in gap 11 is not shared by the fluid in the interior of conduit 12. It is also seen that collar 21 together with conduit 12 and helically disposed sealing material 13 may be detached and removed from the cryostat penetration. This removal is typically undertaken for the purpose of establishing electrical connections with circuits in the interior of the cryostat.

Next is considered the construction of the insert plug itself. In particular, this insert is seen to comprise a plurality of foam plugs disposed within and substantially filling thin wall tube 17. This tube typically comprises material such as glass fiber. These foam plugs exhibit a low thermal conductivity and are preferably densely packed within tube 17. Foam plugs 15 typically comprise cylindrical styrofoam sections which are approximately one inch in height. Furthermore, the insert also includes a plurality of thermally conductive foil patches 16 disposed between the foam plugs. The foil patches preferably comprise aluminum or copper foil which is between about 1 and about 10 mils in thickness. The foil patches are preferably affixed to the foam plugs by adhesive bonding. Additionally, it is desirable that the foil patches are disposed so as to be in thermal contact with tube 17. The insert comprising tube 17, plugs 15 and foil patches 16 is disposed within inner tubular conduit 12 and is particularly dimensioned so as to be readily ejectable therefrom through rupture disk 20 as a result of over pressure conditions. Thus, the insert plug is seen to provide thermal isolation between the cryostat interior and exterior while at the same time maintaining isothermal conditions at various points along the length of the penetration, as particularly determined by the location of the foil patches. These locally isothermal conditions are enhanced by the helical flow path.

Figure 2:
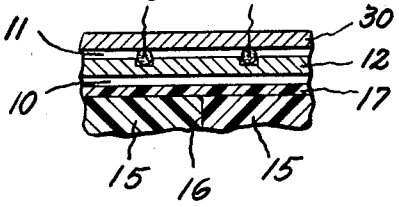
FIG. 2 is an enlarged cross-sectional side elevation view of a small portion of the penetration illustrated in FIG. 1.

Since several of the structures shown in FIG. 1 are in fact thin walled structures, clarity of illustration is enhanced in FIG. 1 through the depiction of these elements as single lines. Accordingly, FIG. 2 provides an enlarged cross sectional view (of the section illustrated in FIG. 1) of the thin walled structures employed herein. All of the elements illustrated in FIG. 2 have been described above, however, it is of note to indicate that sealing material 13 may in fact be disposed in helical grooves provided in inner tubular conduit 12. Such a construction facilitates removal of the assembly of the present invention. However, those skilled in the art will readily appreciate that it is also possible to provide outer tubular conduit 30 with similar helically disposed grooves. However, such is not the preferred embodiment of the present invention.

Those skilled in the art will also appreciate that while the above description has been provided under the assumption that the penetration exhibits a circular cross section, (see FIG. 3) that other cross sections such as annular ones are possible. However, for ease of understanding and construction, cylindrical structures are preferred. Accordingly, as used herein and in the appended claims, the term "tubular" is not restricted to objects exhibiting circular cross sections, but also includes annular and cylindrical structures having oval, elliptical, square and similar cross sections.

Figure 3:
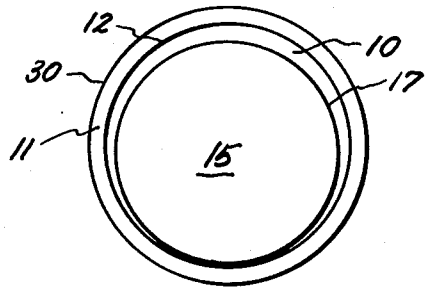
FIG. 3 is an end view, more particularly showing the disposition of the insert in its operative position.

Since it is not necessary to provide a specific support structure for the insert of the present invention, it is seen in FIG. 3 that foam plugs 15 in thin walled tube 17 are readily disposable so that tube 17 rests on the bottom of inner tubular conduit 12. This arrangement is particularly illustrated in the end view of FIG. 3.

It should be noted herein that while the low thermal conductivity materials for the tubular conduits discussed above include such materials as stainless steel and glass fiber composites, it is also possible to employ such materials as titanium and nylon or plastic materials exhibiting a low thermal conductivity.

In terms of physical dimension, gap 11 between conduits 30 and 12 is typically between about 2 mils and about 10 mils. Additionally, gap 10 along the top of the tube 17 is typically between about 2 mils to 5 mils in height. Thermally conductive patches 16 are typically between about 1 and about 10 mils in thickness.

More particularly, it is possible to fabricate plugs 15 with foil patches 16 in place. For example, the desired thermally conductive foil patch may be adhesively affixed to a one inch thick slab of thermally insulating foam material. Cylindrical sections may then be removed from this slab, for example, by means of a circular punch or appropriate sawing or cutting device. In this way the insert is readily assembled.

It is to be particularly noted that the vapor around the insert plug is not exhausted to the external environment. Therefore, back diffusion of water vapor into that space is not possible. Consequently, even if frost develops in gap 11, gap 10 around the insert plug remains free of frost. This insures that the insert blows out freely upon rupture of disk 20.

From the above, it may be appreciated that the insert and penetration assembly of the present invention provides a thermally efficient horizontal cryostat penetration. In particular, it is seen that the present invention significantly mitigates any effects resulting from free convection secondary flows in the penetration itself. It is also seen that the present invention provides a high degree of thermal insulation in a manner which does not impede the exhaust of coolant gases in the event of magnet quench or vacuum loss. In short, the present invention provides a thermally efficient horizontal cryostat penetration insert and assembly that reliably relieves internal vessel pressure.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. An insert for horizontal cryostat penetration comprising:

a thin wall, low thermal conductivity tube;

a plurality of foam plugs disposed within and substantially filling said tube; and a plurality of thermally conductive foil patches disposed between at least two of said foam plugs.

2. The insert of claim 1 in which said patches comprise material selected from the group consisting of aluminum or copper.

3. The insert of claim 1 in which said patches are from approximately 1 mil to 10 mils in thickness.

4. The insert of claim 1 in which said tube comprises glass fiber material.

5. The insert of claim 1 in which said foil patches are adhesively bonded to said plugs.

6. The insert of claim 1 in which said patches are in thermal contact with said tube.

7. The insert of claim 1 in which said foam plugs are densely packed within said tube.

8. The insert of claim 1 in which said patches are disposed between all of said plugs.

9. The insert of claim 1 in which said tube exhibits a substantially circular cross section.

10. A horizontal penetration assembly for a cryostat having an inner vessel wall and an outermost vessel wall comprising:

an outer tubular conduit passing at least partially through an aperture in said inner vessel wall and an aperture in said outermost vessel wall, said conduit being sealably joined to said inner and outermost vessel walls;

an inner tubular conduit disposed substantially coaxially with said outer conduit; and at least one string-shaped length of sealing material disposed in a helical pattern between said inner and outer conduits so as to define a helical path therebetween, said path being in flow communication with the interior of said inner vessel.

11. The penetration assembly of claim 10 in which said sealing material is disposed in grooves along the exterior of said inner tubular conduit.

12. The penetration assembly of claim 10 in which the pitch of said helix increases in the direction from the inner vessel wall to said outermost vessel wall.

13. The penetration assembly of claim 10 in which said sealing material comprises twine.

14. The penetration assembly of claim 10 in which said helical path is also in flow communication with the volume exterior to said outermost cryostat wall.

15. The penetration assembly of claim 10 in which a plurality of string-shaped lengths of sealing material are disposed in an equal plurality of helical patterns between said inner and outer tubular conduits so as to define a plurality of parallel helical paths therebetween.

16. The penetration assembly of claim 10 further including an exterior flange to which said inner conduit is sealably attached, said flange also being sealably attachable to said outermost cryostat wall.

17. The penetration assembly of claim 16 further including a rupture disk sealably affixed to said flange, said rupture disk being disposed so as to be in line with said aperture in said outermost vessel wall.

18. The penetration assembly of claim 17 in which said flange possesses a passage in flow communication with said helical path, said passage being in flow communication with the volume exterior to said outermost cryostat wall.

19. The penetration assembly of claim 10 further including an insert comprising a thin wall, low thermal conductivity tube;

a plurality of foam plugs disposed within and substantially filling said tube; and a plurality of thermally conductive foil patches disposed between at least two of said foam plugs, said insert disposed within said inner tubular conduit.

20. The penetration assembly of claim 19 in which the clearance between said insert and said inner tubular conduit is between about 2 mils and about 5 mils.

21. The penetration assembly of claim 10 in which said inner tubular conduit comprises material selected from the group consisting of stainless steel, glass fiber, titanium and nylon.

22. The penetration assembly of claim 10 in which said outer tubular conduit comprises material selected from the group consisting of stainless steel, glass fiber, titanium and nylon.

23. The penetration assembly of claim 10 in which said conduits exhibit a substantially circular cross section.

24. A removable insert assembly for use in a horizontal cryostat penetration, said removable insert comprising:

a flange having an aperture therein, said flange being sealably affixable to a wall having an aperture aligned with said flange aperture;

a rupture disk sealably affixed over said aperture in said flange;

a tubular conduit sealably affixed within said aperture in said flange; and at least one string-shaped length of sealing material disposed in a helical pattern along the exterior of said conduit.

25. The removable insert assembly of claim 24 in which said string-shaped length of sealing material is disposed in helical grooves along the exterior of said tubular conduit.

26. The removable insert assembly of claim 24 in which the pitch of said helix decreases in a direction away from said flange.

27. The removable insert assembly of claim 24 in which said sealing material comprises twine.

* * * * *